US005303649A

United States Patent [19]

Reder et al.

[11] Patent Number: 5,303,649

[45] Date of Patent: Apr. 19, 1994

[54] INK CONTAINER

[75] Inventors: Wolfgang O. Reder, Veitshoechheim; Dieter Reinhart, Hettstadt; Georg Schneider, Würzburg, all of Fed. Rep. of Germany

[73] Assignee: Koenig & Bauer Aktiengesellschaft, Wurzburg, Fed. Rep. of Germany

[21] Appl. No.: 926,702

[22] Filed: Aug. 10, 1992

[30] Foreign Application Priority Data

Aug. 13, 1991 [DE] Fed. Rep. of Germany ..... 4126722

[51] Int. Cl.[5] ..... B41F 31/06; B41G 27/10

[52] U.S. Cl. ..... 101/363; 101/366

[58] Field of Search ..... 101/366, 350, 364, 363, 101/207, 208, 209, 210, 148; 118/259, 261, 263

[56] References Cited

U.S. PATENT DOCUMENTS

| | | | |
|---|---|---|---|
| 3,561,357 | 2/1971 | Schinke | 101/364 |
| 4,864,925 | 9/1989 | Van Kanegan | 101/366 |

FOREIGN PATENT DOCUMENTS

| | | | |
|---|---|---|---|
| 0182325 | 11/1985 | European Pat. Off. . | |
| 0258519 | 2/1987 | European Pat. Off. . | |
| 0286305 | 3/1988 | European Pat. Off. . | |
| 0355590 | 8/1989 | European Pat. Off. . | |
| 0355608 | 8/1989 | European Pat. Off. . | |
| 0359957 | 8/1989 | European Pat. Off. . | |
| 2851426 | 11/1978 | Fed. Rep. of Germany . | |
| 0113488 | 9/1981 | Japan | 101/364 |
| 196255 | 11/1984 | Japan | 101/364 |
| 2-297443 | 5/1989 | Japan . | |
| 268178 | 8/1947 | Switzerland . | |

*Primary Examiner*—J. Reed Fisher

*Attorney, Agent, or Firm*—Jones, Tullar & Cooper

[57] ABSTRACT

A two chamber ink container for a short inking unit of an offset rotary printing unit is generally funnel shaped and has an ink reservoir chamber and a feedback chamber. A separating plate divides the ink container into its two chambers. A lower portion of the separating plate defines a flow passage for the ink and doctored-off ink and water back to an ink pump and thence to a chambered doctor blade.

7 Claims, 2 Drawing Sheets

12
18
14
A
17
31
32
34
33
21

12
29
18
14
A
17
28

12
18
14
17
24
27
26
21

INK CONTAINER

FIELD OF THE INVENTION

The present invention is directed generally to an ink container. More particularly, the present invention is directed to an ink container for feeding ink to a chambered doctor blade. Most specifically, the present invention is directed to an ink container for feeding ink to a chambered doctor blade in a short inking unit of an offset rotary printing press. The ink container is separated into two chambers which are both in fluid flow communication with an ink pump. A first of these chambers receives an ink and water mixture which is returned from the doctor blade and a second of these chambers receives fresh ink. The contents of the two chambers are fed to the ink supply pump at a metered rate.

DESCRIPTION OF THE PRIOR ART

In inking units of offset rotary printing presses, and particularly in short inking units, the ink is continually circulated between a chambered doctor blade and an ink pump. This recirculating ink mixes with dampening fluid that is also supplied to the surface of the screened ink roller. Thus the ink is continually mixed with water so that it continually undergoes physical changes, particularly in viscosity. These changes in ink viscosity can have detrimental effects on the quality of the products being printed by the offset rotary printing press.

One solution to this problem is proposed in European Patent Application No. 0 182 325 A2. This application discloses a device for mixing the ink and water mixture which is doctored off the screen roller with ink in the ink fountain, some of which ink is freshly supplied. In this device, the doctored off ink and water is fed into the ink fountain in an area which is far away in the ink fountain from the area where the ink is removed from the fountain by a pan roller. The use of this relatively long distance between the point of doctored off ink and water return to the ink fountain and the point of ink pick up by the ink fountain pan roller provides a good mixing and blending of the doctored off ink with the newly supplied ink in the ink trough.

A limitation of this prior art device is that the doctored off ink and water mixture that runs back into the trough has a different viscosity from the ink in the ink trough. This difference in ink viscosities may be too great to allow the doctored off ink and water to thoroughly mix with the newly supplied ink in the ink trough before the ink is removed by the pan roller. This failure of the doctored off ink and water to properly mix with the fresh ink results in viscosity fluctuations which can lead to problems with print quality.

It will thus be seen that a need exists for an ink container which will facilitate uniform, proper mixing of doctored off ink and water with fresh ink. The ink container of the present invention provides such a device and is a significant improvement over the prior art devices.

SUMMARY OF THE INVENTION

It is an object of the present invention to provide an ink container.

Another object of the present invention is to provide an ink container for feeding ink to a doctor blade.

A further object of the present invention is to provide an ink container for a short inking unit of an offset rotary printing press.

Yet another object of the present invention is to provide an ink container having two chambers.

Still a further object of the present invention is to provide an ink container which provides a proportioned flow of fresh ink and doctored off ink and water.

Even yet another object of the present invention is to provide a chambered ink container in which an ink flow passage is adjustable.

As will be discussed in greater detail in the description of the preferred embodiments which are set forth subsequently, the ink container of the present invention is separated into two chambers. A first of these chambers receives a mixture of ink and damping fluid that has been doctored off the screened surface ink roller by a doctor blade. The second chamber of the ink container is provided with fresh ink. A separating plate divides the ink container into the two chambers. A flow passage, which can be adjustable, allows a controlled flow of the contents of the two chambers to an ink pump which supplies the ink mixture to the chambered doctor blade.

A primary advantage of the ink container of the present invention is its ability to maintain a uniform supply of ink to the screened roller of the offset rotary printing press. The volume of the chamber which receives the doctored off ink and water mixture is less than the volume of the chamber that supplies the fresh ink. Only the quantity of ink in the feedback chamber, which receives the doctored off ink and water, that is used, is replaced. This insures that the ink supplied to the chambered doctor blade will have a uniform viscosity and quality so that the quality of the printed work will remain high.

The ink container of the present invention overcomes the limitations of the prior art devices. The ink container of the present invention is a substantial advance in the art.

BRIEF DESCRIPTION OF THE DRAWINGS

While the patentable features of the ink container of the present invention are set forth with particularity in the appended claims, a full and complete understanding of the invention may be had by referring to the detailed description of the preferred embodiments which is presented subsequently, and as illustrated in the accompanying drawings in which:

DESCRIPTION OF THE PREFERRED EMBODIMENTS

Figure 1:
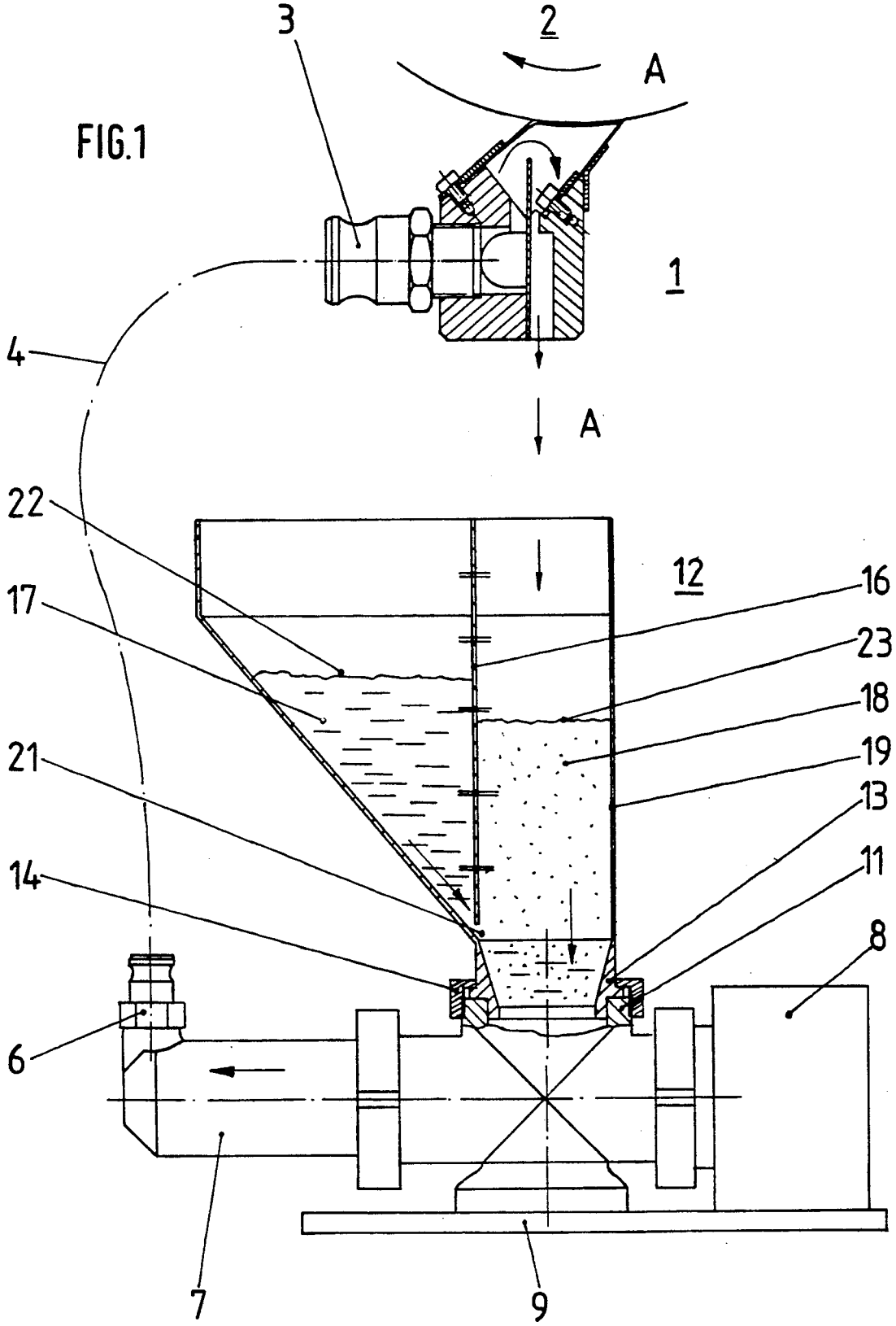
FIG. 1 is a schematic side elevation view of an inking unit with a first preferred embodiment of an ink container in accordance with the present invention.

Referring initially to FIG. 1, there may be seen generally at 1 a chambered doctor blade which is positioned beneath a screened roller 2 in an offset rotary printing press. The chambered doctor blade 1 and the screened roller 2 are supported between side plates, which are not specifically shown, of a machine frame for the printing press. The screened roller 2 is supported for rotation in the direction indicated by the arrow A on the depiction of the roller 2.

The chambered doctor blade includes a doctor blade ink supply connector at 3 and this connector 3 is joined to a first end of an ink feed line 4 which is depicted schematically in FIG. 1. A second end of the ink feed line 4 is connected to an ink pump supply connector 6 of an ink pump 7. The ink pump 7 is operated by a flanged motor 8 and the ink pump 7 and pump motor 8 are supported on a base plate 9.

An ink inlet connector 11 is formed on the ink pump 7 on a surface of the ink pump 7 opposing the base plate 9. A two chamber ink container, generally at 12, in accordance with the present invention, is attached to the ink pump inlet connector 11. The two chamber ink container 12 is generally funnel-shaped in crosssection and has a flanged lower end 13 which is secured to the ink pump inlet connector 11 by a threaded flange 14.

Two chamber ink container 12, which widens towards its upper portion or top, is divided by a generally vertical separating plate 16 into an ink reservoir or chamber 17 and a feedback chamber 18. The separating plate 16 extends parallel to a vertical sidewall 19 of the ink container and extends along the length of the ink container 12 in an axial direction with respect to the screened roller 2. It will be understood that the ink container 12 may have a length which is the same as, or an increment such as one fourth or one half the length of the screened roller 2. In a first preferred embodiment of the ink container 2, ends of the separating plate 16 may be rigidly connected with endwalls, not specifically shown, of the two chamber ink container 12 such as, for example, by welded seams. Alternatively, the separating plate 16 can be movable toward and away from the vertical side wall 19. This could be accomplished by providing a slide with lateral guides (not specifically shown) so that the separating plate 16 could be moved.

An ink flow passage 21 is defined by the lower end of the separating plate 16 and an angled side wall of the ink container. This ink flow passage 21 links the ink chamber or reservoir 17 with the feedback chamber 18. The level of newly supplied printing ink that is fed into the chamber 17 is depicted by the ink level line 22. In the feedback chamber 18 there is the fluid which is doctored off the screen roller 2 by the chambered doctor blade 1. This doctored off fluid consists of ink and dampening fluid, such as water that is supplied to the screen roller 2 by a dampening fluid assembly not shown in the drawings. This doctored off fluid leaves the chambered doctor blade 1 in the direction indicated by the arrow A and is collected in the feedback chamber 18. The fill height in the feedback chamber 18 is indicated by feedback chamber level line 23. In consequence of the different viscosities of the fluids in the ink reservoir chamber 17 and the feedback chamber 18, the fill height in the feedback chamber 18 is inferior to, or less than the fill height in the ink reservoir chamber 17.

During operation of the short inking unit of the offset rotary press in accordance with the present invention, in which the screened ink roller 2 is rotating in the direction indicated by arrow A, there is fed a mixture of ink and water from the chambered doctor blade 1 into the feedback chamber 18 of the two chamber ink container 12. As the ink pump 7 operates, a portion of this doctored off mixture from feedback chamber 18 is fed, together with a portion of the new ink from the ink reservoir chamber 17 that passes through the flow passage 21, out through the ink pump supply connector 6 and through the ink feed line 4 and the doctor blade ink supply connector 3 to the chambered doctor blade 1. The two chamber ink container 12 of the present invention thus insures that a continuous and even feed of portions of new ink from ink reservoir chamber 17 and portions of doctored off ink and dampening fluid form feedback chamber 18 will be supplied to the chambered doctor blade 1.

Figures 2, 3, 4:
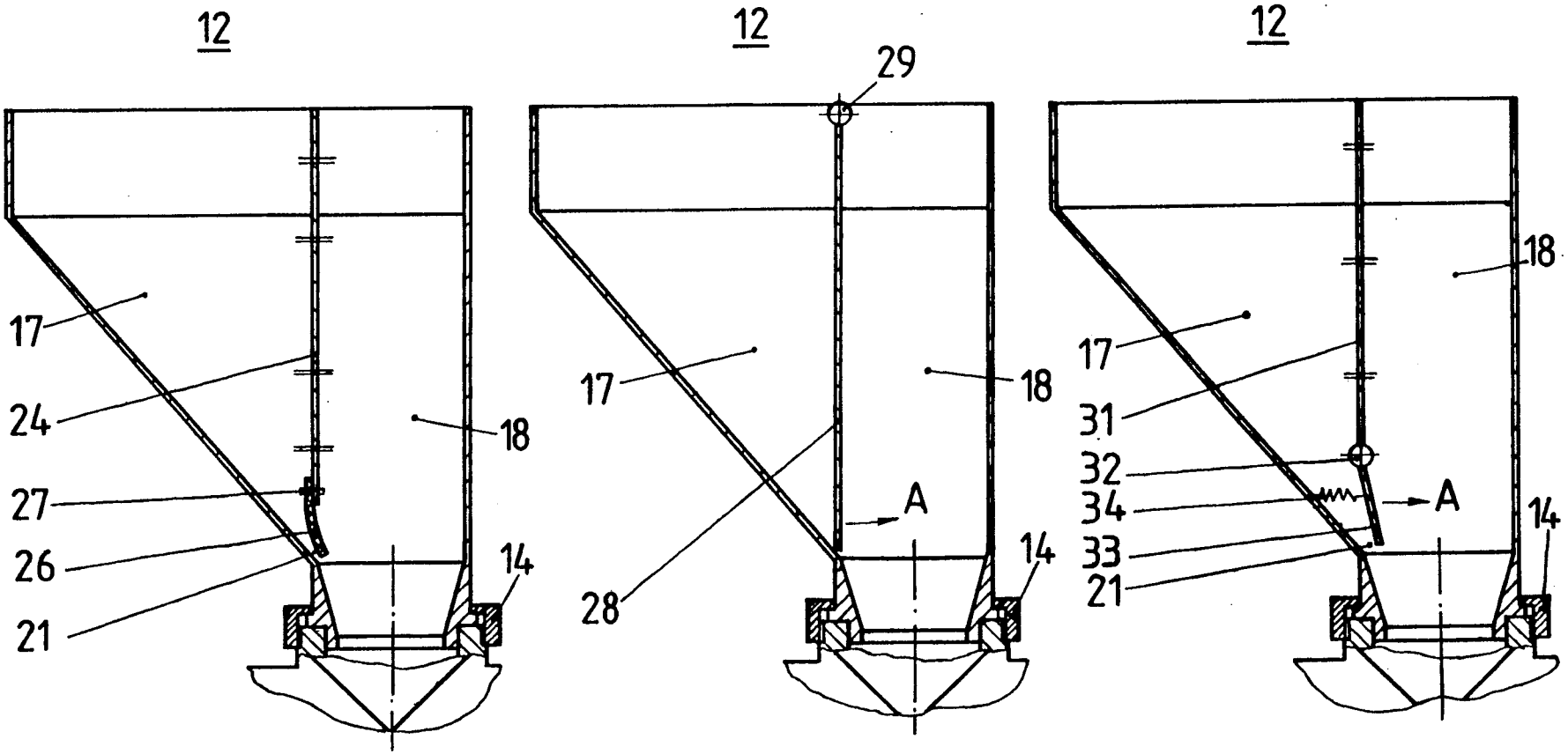
FIG. 2 is a cross-sectional side elevation view of a portion of a second preferred embodiment of an ink container in accordance with the present invention.
FIG. 3 is a cross-sectional side elevation view of a portion of a third preferred embodiment of an ink container in accordance with the present invention.
FIG. 4 is a cross-sectional side elevation view of a portion of a fourth preferred embodiment of an ink container in accordance with the present invention.

Turning now to FIG. 2, there may be seen a second preferred embodiment of a two chamber ink container in accordance with the present invention. In this second preferred embodiment, a separating plate 24, which is similar in function to the separating plate 16 of the first embodiment, has a strip-shaped seal 26 at its lower end. This seal 26 is made of a flexible material, such as rubber and is secured to the separating plate 24 by suitable fastening means such as rivets 27. The flow passage 21 of the second preferred embodiment of the two chamber ink container 12 is increased in size by flexation of the strip-shaped seal 26.

Referring now to FIG. 3 which shows a third preferred embodiment of a two chamber ink container 12, the separating plate 28 which separates the ink reservoir chamber 17 and the feedback chamber 18 is supported for pivotably or swivelling movement in the direction indicated by arrow A in FIG. 3. An upper end of the pivotable separating plate 28 is supported by pivot axles 29 at the upper portion of the funnel-shaped ink container 12. Suitable means can be provided to control the amount of movement of the swivelling separating plate 28 to thereby control the area of the flow passage 21.

A fourth preferred embodiment of a two chamber ink container 12 in accordance with the present invention can be seen in FIG. 4. In this preferred embodiment, the separating plate 31 is fixedly secured to the ink container 12 in a manner similar to that in FIG. 2. At the lower end of the separating plate 31 there is provided a movable flap 33. This flap 33 is supported by swivelling axles 32 so that it can be opened against the force of suitable draw springs 34 to thereby provide a flow passage 21.

While preferred embodiments of a two chamber ink container in accordance with the present invention have been set forth fully and completely hereinabove, it will be apparent to one of skill in the art that a number of changes in, for example, the overall size of the container, the types of printing ink used, the materials used to form the ink container, and the like can be made without departing from the true spirit and scope of the present invention which is accordingly to be limited only by the following claims.

What is claimed is:

1. An ink container for an inking unit of an offset rotary printing press having a screened roller and a chambered doctor blade, said ink container comprising:
   - an ink reservoir chamber for receipt of new ink;
   - a feedback chamber for receipt of doctored off ink and dampening fluid;
   - a separating plate positioned within said ink container and dividing said ink container into said ink reservoir chamber and said feedback chamber; and
   - a flow passage defined in part by a lower end of said separating plate, said flow passage having a variable flow area and providing fluid communication between said ink reservoir chamber and said feedback chamber, said separating plate being supported for pivotal movement at an upper end in several axles adjacent an open, upper end of said ink container, said pivotal movement of said separating plate shifting said lower end of said separating plate to vary said flow area of said flow passage.

2. The ink container of claim 1 wherein said separating plate is generally parallel to a vertical side wall of said ink container.

3. An ink container for an inking unit of an offset rotary printing press having a screen roller and a chambered doctor blade, said ink container comprising:

an ink reservoir chamber for receipt of new ink;

a feedback chamber for receipt of doctored off ink and dampening fluid;

a separating plate positioned within said ink container and dividing said ink container into said ink reservoir chamber and said feedback chamber, said ink container being generally funnel shaped and having a lower discharge end;

a flow passage defined in part by a lower end of said separating plate, said flow passage providing fluid communication between said ink reservoir chamber and said feedback chamber; and an ink pump having an inlet connector, said lower discharge end of said ink container being detachably connectable with said inlet connector of said ink pump.

4. The ink container of claim 3 wherein a flow area of said flow passage is variable.

5. The ink container of claim 4 wherein said lower end of said separating plate has a flexible strip, said flexible strip being deformable to vary said flow area of said flow passage.

6. The ink container of claim 3 wherein said separating plate has a movable flap at said lower end, and further including at least a first draw spring, said draw spring being connected at a first end to said movable flap and at a second end to said ink container, said movable flap being supported in swivelling axles and being openable against the force of said at least first draw spring to vary said flow area of said flow passage.

7. The ink container of claim 3 wherein said feedback chamber is arranged above said inlet connector of said ink pump.

* * * * *